United States Patent [19]

Schloemann

[11] Patent Number: 4,853,660

[45] Date of Patent: Aug. 1, 1989

[54] INTEGRATABLE MICROWAVE DEVICES BASED ON FERROMAGNETIC FILMS DISPOSED ON DIELECTRIC SUBSTRATES

[75] Inventor: Ernst F. R. A. Schloemann, Weston, Mass.

[73] Assignee: Raytheon Company, Lexington, Mass.

[21] Appl. No.: 213,669

[22] Filed: Jun. 30, 1988

[51] Int. Cl.[4] ..... H01P 1/203; H01P 1/11; H01P 7/08

[52] U.S. Cl. ..... 333/204; 333/205; 333/219.2; 333/235; 333/246; 333/262

[58] Field of Search ..... 333/202, 204, 205, 219, 333/246, 24.1, 262, 185, 235, 201, 24.2, 219.2, 101, 102; 357/27; 331/96, 107 DP, 107 SL, 117 D, 154, 157

[56] References Cited

U.S. PATENT DOCUMENTS

| | | | |
|---|---|---|---|
| 3,257,629 | 6/1966 | Kornreich | 333/161 |
| 3,399,361 | 8/1968 | Belson | 333/161 |
| 3,458,837 | 7/1969 | Ngo | 333/205 |

*Primary Examiner*—Marvin L. Nussbaum

*Attorney, Agent, or Firm*—Denis G. Maloney; Richard M. Sharkansky

[57] ABSTRACT

Integratable microwave devices such as a tuneable band reject filter or an r.f. switch are provided on a gallium arsenide substrate having a (100) orientation. Each of the devices includes a layer of a ferromagnetic material having a pair of easy axes which lie in the plane of said (100) orientated substrate and a layer of a conductive, nonmagnetic material disposed thereover. The ferromagnetic material has a ferromagnetic resonant frequency related to the applied DC magnetic field, the anisotropy field, the saturation magnetization, and gyromagnetic ratio. Such devices are provided by utilizing the ferromagnetic resonant properties of the ferromagnetic material disposed on the (100) substrate.

22 Claims, 8 Drawing Sheets

INTEGRATABLE MICROWAVE DEVICES BASED ON FERROMAGNETIC FILMS DISPOSED ON DIELECTRIC SUBSTRATES

BACKGROUND OF THE INVENTION

This invention relates generally to microwave devices and more particularly to microwave magnetically tuned devices which can be integrated with microwave monolithic integrated circuits.

As is known in the art, so-called monolithic microwave, and millimeter wave integrated circuits include active and passive devices which are formed using semiconductor integration circuit techniques to provide various types of microwave and millimeter wave circuits. In particular, monolithic microwave integrated circuits which include field effect transistors, transmission lines, resistors, and capacitors may be interconnected to provide various microwave circuits such as amplifiers, filters, switches, and the like. Such monolithic microwave integrated circuits are generally fabricated on materials such as gallium arsenide which have generally accepted characteristics which make their performance suitable at microwave frequencies.

Two types of microwave devices which are commonly employed in the art are so-called band reject filters and switches.

Band reject filters, are frequently used in electronic counter measurement systems (ECM), as well as, electronic support measures systems (ESM), particularly in receiver channels to suppress a strong signal in a certain frequency band, when it is desired to detect and process other signals particularly weaker signals located in adjacent frequency bands. Such filters are also commonly employed in certain radar systems to isolate the radar receiver path from a transmitted signal during radar transmission particularly when the transmitter and receiver share a common signal path. Commonly, a tuneable band pass filter is employed in such radar systems and during transmission it is detuned from the frequency of the transmitted signal.

Generally, the filters described above include YIG-sphere resonators that are tuned by means of an externally applied magnetic field. Several disadvantages occur with the use of YIG tuned resonators. A significant disadvantage is that although YIG filters have been built using photolithographic techniques, the requirement of the orientated YIG sphere, as well as, difficulty with electromagnetic coupling to the sphere make such magnetically tuneable devices based upon YIG sphere resonators not readily integratable with semiconductor circuits. Furthermore, if the filter has to operate at relatively high microwave or millimeter wave frequencies typically above 20 GHz, for example, a very large magnetic field is required to provide the requisite resonant circuit. At 20 GHz, it becomes very difficult to provide a large magnetic field in a package of small, acceptable size in applications where size is important.

Accordingly, a magnetically tuned circuit which may be fabricated using semiconductor integration circuit techniques and which may be directly integrated with such integrated circuits would be desirable. Further, circuits which operate at lower magnetic field strengths and which are also compact would also be desirable.

SUMMARY OF THE INVENTION

In accordance with the present invention, a radio frequency circuit element includes a dielectric substrate having on a first surface thereof a ground plane conductor. Disposed over a second, opposite surface of the dielectric substrate is a patterned composite strip conductor, said patterned composite strip conductor comprising a first patterned conductive layer comprised of a ferromagnetic material and a second patterned layer comprised of a nonmagnetic conductive material disposed over said first layer of ferromagnetic material. With this arrangement, a tuneable band reject filter is provided. The ferromagnetic material has a ferromagnetic resonant frequency which is related to the anisotropic field, the saturation magnetization and the gyromagnetic ratio of the ferromagnetic film. A signal fed to this circuit will pass through substantially unattenuated unless the signal has a frequency related to the ferromagnetic resonant frequency of the material. Signals having a frequency in the vicinity of the ferromagnetic frequency will be absorbed by the circuit. Thus, the circuit acts as a band stop or band reject filter. If a DC magnetic field is disposed parallel to the direction of the propagation of the signal, the DC magnetic field will provide a corresponding change in the resonant frequency of the ferromagnetic material. This arrangement provides a tuneable band reject or band stop filter. Furthermore, if an external DC magnetic field is provided normal to the direction of propagation and in the plane of the ferromagnetic layer, the ferromagnetic resonance mode is not excited and, therefore, there is substantially no attenuation of the signal fed to the circuit. By switching the DC magnetization from an orientation parallel to the direction of propagation to an orientation normal to the direction of propagation, the above described structure can also be used as a switch that has a broadband low insertion loss in one state and a relatively narrow band high absorption in the opposite state, and thus a switched, band reject filter is provided.

In accordance with a further aspect of the present invention, a band reject filter comprises a cubic single crystalline substrate having a surface of (100) faces. A patterned, composite strip conductor disposed on said (100) surface comprising a first layer of a crystalline ferromagnetic material having a pair of easy axes which lie in the plane of said (100) surface and a second layer disposed over said first layer comprising a conductive nonmagnetic material with said second layer and first underlying layer, each disposed with respect to said (100) orientated substrate surface, such that the propagation direction along the patterned composite strip conductor is parallel to one of easy axes of said first layer of magnetic material. With this particular arrangement, by using the surface of a (100) substrate and by depositing a ferromagnetic film on this (100) surface having a pair of easy axes disposed in the plane of the (100) surface, a DC magnetic field applied parallel to the propagation direction along the composite conductor will permit the frequency at which the band reject filter has a maximal insertion loss (i.e. when the ferromagnetic layer is at resonant and hence, absorption is at a maximum) to be adjusted since it is dependent upon the externally supplied magnetic field thus providing a tuneable band stop filter.

In accordance with a further aspect of the present invention, a r.f. switch includes a cubic single-crystal substrate having a (100) surface and a patterned composite strip conductor disposed over said (100) surface, said composite strip conductor includes a first layer comprised of a magnetic material having a pair of easy axes which lie in the plane of said (100) surface. The layer of magnetic material has first and second strip portions which have a common terminus and which are disposed orthogonal to one another in the common plane of said (100) surface. The first and second strip portions are disposed parallel to respective ones of said easy axes of said magnetic material. The composite strip conductor further includes a second layer of a conductive, non-magnetic material having first and second mutually orthogonal portions having a common terminus and disposed over said first and second magnetic strip portions, and a third portion connected at the terminus of said first and second portions, and disposed on said substrate. With this particular arrangement, a single pole, double-throw r.f. switch is provided. A microwave signal entering the input i.e. the third strip conductor portion is split in half with no energy being reflected. If the ferromagnetic material disposed under the two branches of the strip conductor is magnetized uniformly in either the <010> or the <001> directions, one of the output branches will have a higher attentuation than the other output branch due to the excitation of ferromagnetic resonance at a certain frequency band. Thus, the structure acts as a single pole, double-throw switch having broadband low insertion loss in one state (i.e. in which the ferromagnetic resonance is not excited) and narrowband high absorption as in the other state (i.e. in which the ferromagnetic resonance is excited).

In accordance with a still further aspect of the present invention, a small electromagnet suitable for use to provide an external D.C. magnetic field to the tuneable circuits includes a substrate comprised of a ferrite material, said substrate having four salients thereon with a coil disposed around each of said salients. Alternatively, a pair of coils are provided about the substrate with each coil disposed around a pair of opposing edges of said substrate. With such an arrangement, in response to currents of suitable polarities fed to the coils, an electromagnetic having a pair of mutually orthogonal magnetization directions is provided.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENTS

Figure 1:
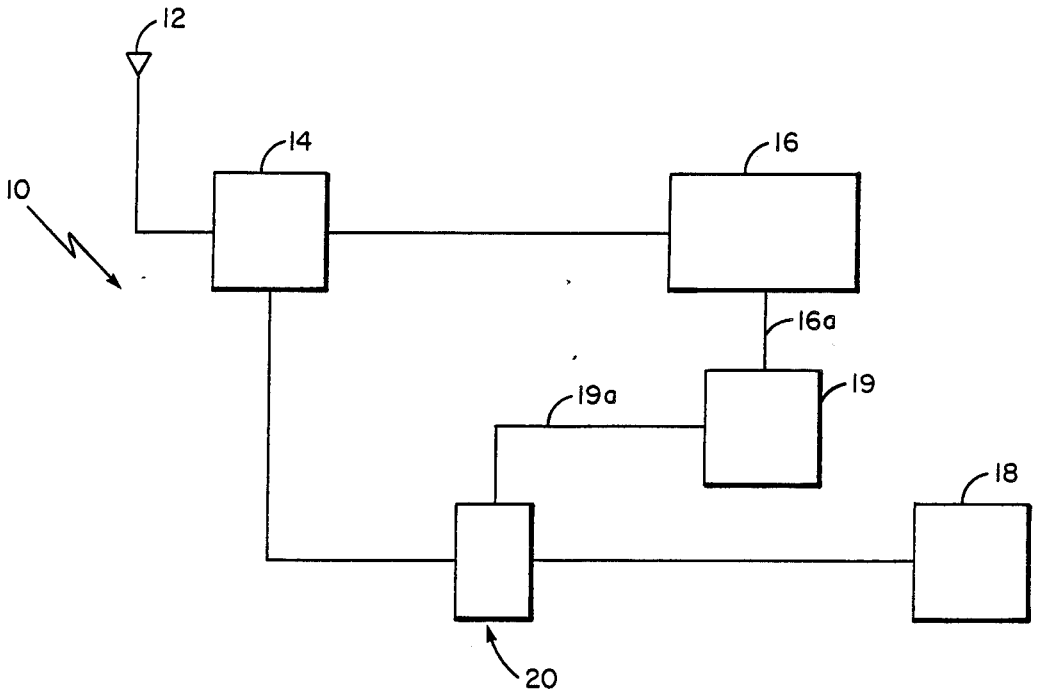
FIG. 1 is a block diagram of a radar having a switchable/tuneable band reject filter disposed to block leakage of a transmitted signal into a receiver.

Referring now to FIG. 1, a typical radar system 10 is shown to include an antenna 12 coupled to a duplexer 14. A first port of duplexer 14 is connected to a first path via a transmitter 16, and a second port of duplexer 14 is coupled to a receiver 18 via a band stop filter 20, as shown. A control circuit 19 is fed a signal, via path 16*a*, from the transmitter 16 to provide a signal, via path 19*a*, to the band stop filter 20 to switch the band stop filter 20 between a pair of states. In the first state, the band stop filter will be switched to stop or prevent passing of signals having a frequency corresponding to the frequency of the transmitted signal from transmitter 16 (i.e. during a transmit mode) as may occur because of leakage of the signal through the duplexer 14; whereas in a second state, the band stop filter will permit without significant attenuation signals to be coupled from antenna 12 to the receiver 18 (i.e. during a receive mode). Preferred embodiments of the band stop filter 20 will now be described in conjunction with FIGS. 2–8.

Figure 2:
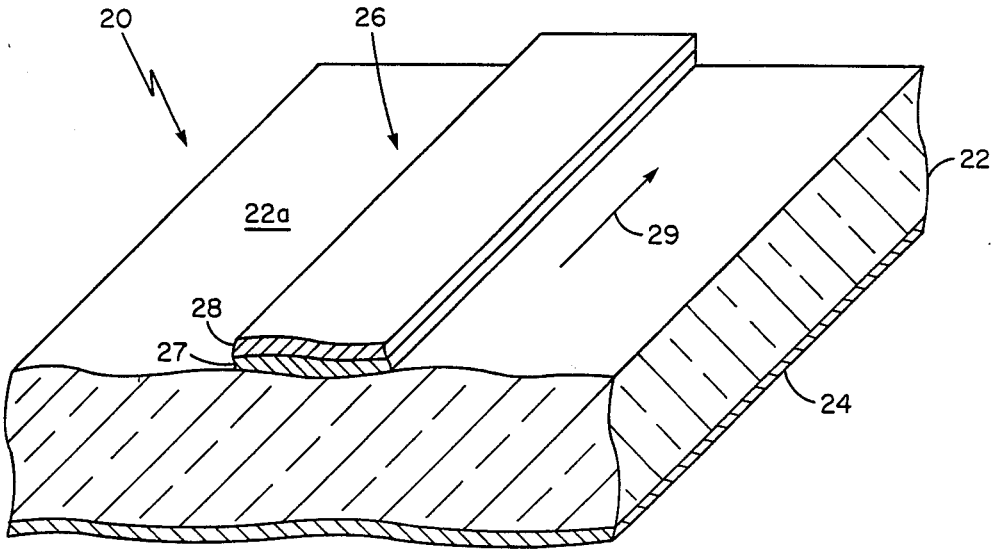
FIG. 2 is an isometric view of a band reject filter in accordance with a first aspect of the present invention.

Referring first to FIG. 2, a band stop filter 20 is shown to include a substrate 22 here comprised of a dielectric or semiconductor material such as gallium arsenide having a surface 22*a* of (100) crystalline planes or faces, having disposed over surface 22*a*, a composite strip conductor 26 comprised of a first layer of an electrically conductive magnetic material 27 such as a layer comprised of iron (Fe) and a second layer 28 of an electrically conductive, non-magnetic material. Layer 27 is arranged on said substrate 22 such that the easy axes of the crystal structure of said layer 27 are disposed in the plane of the substrate surface 22*a* with the easy axes being aligned with the <010> and <001> directions of the substrate 22. Disposed over and here on said iron layer 27 is the conductive layer 28 here of a highly conductive material such as gold. Typically, the layer of iron will have a thickness in the range of about 0.01 micrometers to 0.3 micrometers with 0.1 micrometers being a typically preferred value. Typically, the thickness of conductive layer 28 will be at least twice the thickness of the iron layer 27.

The arrangement shown in FIG. 2 provides a simple band stop or band reject filter 20. It is generally preferred that the width $W_{26}$ of the composite strip conductor 26 is chosen in conjunction with the thickness of the dielectric substrate 22 to provide the microstip transmission line media with a desired characteristic impedance here 50 ohms. Since the orientation of the composite strip conductor 26 with respect to the crystalline axes of the gallium arsenide substrate is chosen such that the microstrip line is parallel to a selected one of the in-plane "easy axis" of the Fe film, (that is either the <010> or <001> axis), when a DC magnetic field is applied parallel to the microstrip conductor as shown in FIG. 2 the strength of this field will determine the frequency at which the microstrip conductor has a maximal ferromagnetic absorption. For a thin film as shown in FIG. 2, the ferromagnetic frequency ($f_{res}$) is related to the applied magnetic field H, the anisotropy field $H_{an}$, the saturation magnetization 4 Ms and the gyromagnetic ratio $\gamma$ by the equation:

$$2\pi f_{res}=\gamma\{(H+H_{an})(H+H_{an}+4\pi M_s)\}^{\frac{1}{2}} \qquad \text{Equation 1}$$

For an iron film at room temperature $4\pi M_s=22{,}000$ Oe; $H_{an}$ 550 Oe; and $\gamma/2\pi=2.8$ MHz/Oe. This implies that for H=0 the resonant frequency of the structure shown in FIG. 2 is approximately 9.86 GHz.

The transmission characteristics of a microstrip line such as shown in FIG. 2 have been analyzed by approximating it as a parallel-plate transmission line. This analysis takes the gyromagnetic properties and the electrical conductivity of the Fe film accurately into account, but is approximate insofar as it assumes that the ground plane and the metal strip covering the Fe film are perfect conductors (infinite conductivity).

The magnetic properties of the magnetic film are characterized by a permeability tensor of the form:

$$\mu=\begin{pmatrix} & -j & 0 \\ j & & 0 \\ 0 & 0 & 1 \end{pmatrix} \qquad \text{Equation 2}$$

The components $\mu$ and $\kappa$ of this tensor can be derived from the Landau-Lifshitz equations (with damping included) and are given by:

$$\mu = 1 + f_M(f_H + j\lambda f)/\{(f_H + j\lambda f)^2 - f^2\} \qquad \text{Equation 3}$$
$$\kappa = -f_M f/\{(f_H + j\lambda f)^2 - f^2\}$$

where $\lambda$ is a phenomenological damping parameter, which is numerically approximately 0.004 for Fe (inferred from line-width measurements on Fe-films at $K_a$-band). The "effective" permeability is given by $$\mu_e = (\mu^2 - \kappa^2)/\mu \qquad \text{Equation 4}$$
$$= 1 + f_M(f_H + f_M + j\lambda f)/\{(f_H + j\lambda f)(f_H + f_M + j\lambda f) - f^2\}$$

In Eqs. (3) and (4) $f_H$ and $f_M$ are given by $$2\pi f_H = \gamma(H + H_{an}) \qquad \text{Equation 5}$$
$$2\pi f_M = \gamma(4\pi M_s)$$

Figure 3:
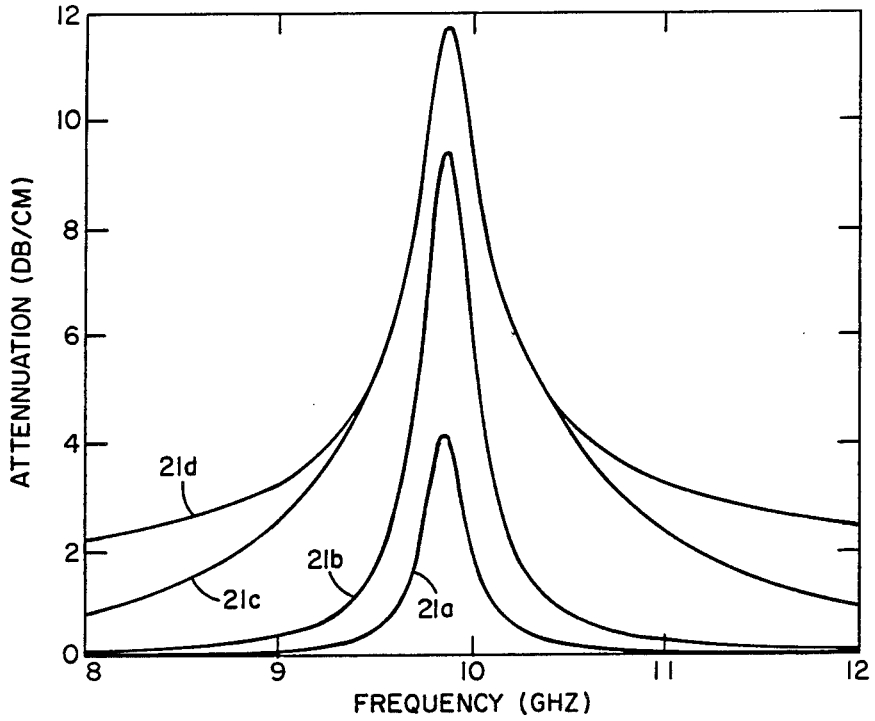
FIG. 3 is a plot of attenuation (in db) versus frequency (GHz) for various thicknesses of a ferromagnetic film used in the device of FIG. 2.
Figure 5:
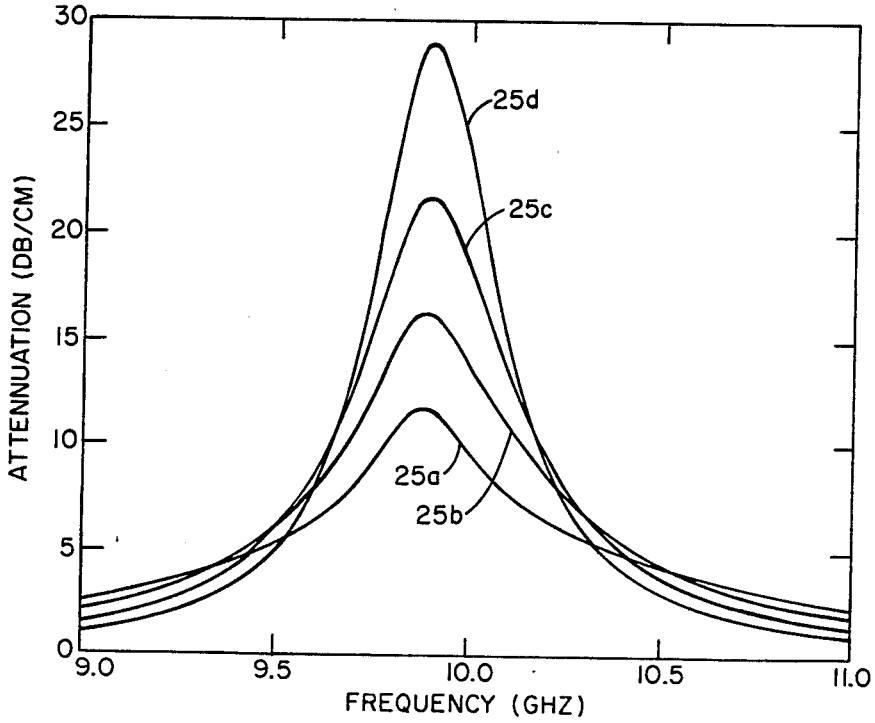
FIG. 5 is a plot of attenutation (db) versus frequency for different electrical conductivities of the ferromagnetic material.

Here some of the results of an analysis of wave propagation relevant to the operation of the band-reject filter are summarized. FIGS. 3 and 5 show the calculated attenuation per unit length of microstrip (in dB/cm) as function of frequency. In all cases the saturation magnetization and the anisotropy field are assumed to have the values appropriate for Fe ($4\pi M_s$ 22000 Oe, $H_a=550$ Oe), the dielectric constant of the substrate is assumed to be 10 and the substrate thickness is assumed to be 100 $\mu$m (0.004"). Dielectric losses in the GaAs substrate are neglected. Magnetic losses in the Fe-fi1m are taken into account by means of the "Landau-Lifshitz" damping parameter $\lambda$.

FIG. 3 shows the calculated attenuation per unit length (in dB/cm) for Fe films of different thicknesses when no magnetic field is applied (but the film is magnetized in a direction parallel to the microstrip). In FIG. 3, curves 21*a* through 21*d* correspond to respective thicknesses of 0.01 $\mu$m, 0.03 $\mu$m, 0.1 $\mu$m, and 0.3 $\mu$m. As expected from Eq. (1) resonance absorption occurs at approx. 9.86 GHz in this case. The height of the peak increases with film thickness when the thickness is very small, but then saturates due to the skin effect.

The skindepth at and near resonance is much smaller than would be expected in a non-magnetic metal of the same conductivity. In a non-magnetic metal the skindepth ($\delta$) can be expressed as $$\delta_{non\ mag} = \sqrt{\frac{2}{\omega\sigma\mu_o}} = \sqrt{\frac{1}{\pi f\sigma\mu_o}} \qquad \text{Equation 6}$$

where $\sigma$ is the conductivity and $\mu_o$ the permeability of vacuum. Using the conductivity of Fe($1/\sigma=8.85\times10^{-8}$ ohm m), one finds for f=10 GHz $$\delta_{non\ mag} \simeq 1.50\ \mu m \qquad \text{Equation 7}$$

In the present context it is convenient to characterize the electrical conductivity $\sigma$ by a frequency $f_c$ according to $$f_c = \frac{\sigma}{2\pi\epsilon_o} \qquad \text{Equation 8}$$

For Fe this frequency is approx. $2\times10^8$ GHz. Equation (6) for the skindepth in a non-magnetic metal can be expressed in terms of $f_c$ as $$\delta_{non\ mag} = \frac{c_o}{2\pi}\sqrt{\frac{2}{f f_c}} \qquad \text{Equation 9}$$

where $c_o$ is the velocity of light in vacuum. This formula is not applicable in a ferromagnetic metal (and especially not at FMR) because it does not take into consideration the large permeability at ferromagnetic resonance. The correct formula for the skindepth at resonance can be shown to be $$\delta_{res} = \frac{c_o}{2\pi}\sqrt{\frac{\lambda}{f_c f_M}}\cdot\sqrt{\frac{f_M + 2f_H}{f_M + f_H}} \qquad \text{Equation 10}$$

Here the last factor is usually very close to unity, and can therefore be neglected. For Fe using the numerical values given above, one finds $$\delta_{res} \simeq 0.028\ \mu m \qquad \text{Equation 11}$$

i.e., a more than 50 times reduction of the skindepth compared to Eq. (7).

From four curves (21a–21d) shown in FIG. 3 which are applicable to film thicknesses of 0.01 μm, 0.03 μm, 0.1 μm, and 0.3 μm, it becomes readily apparent that saturation of the attenuation sets in near 0.03 μm as expected on the basis of Eq. (11).

Figure 4A:
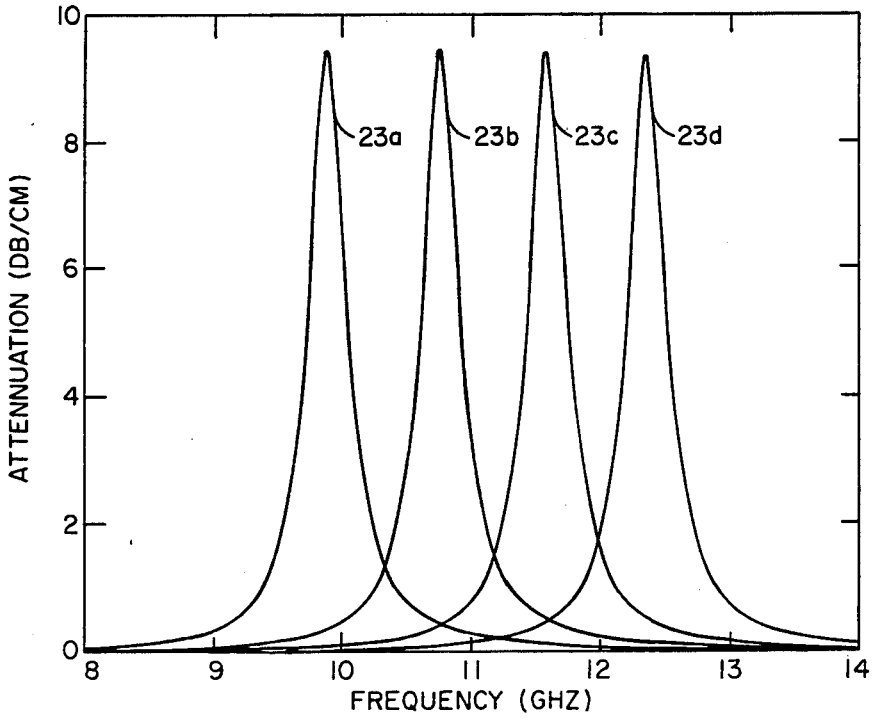
FIGS. 4A and 4B are plots of attentuation versus frequency for various values of DC magnetic field oriented parallel with respect to propagation direction along the device of FIG. 2.
Figure 4B:
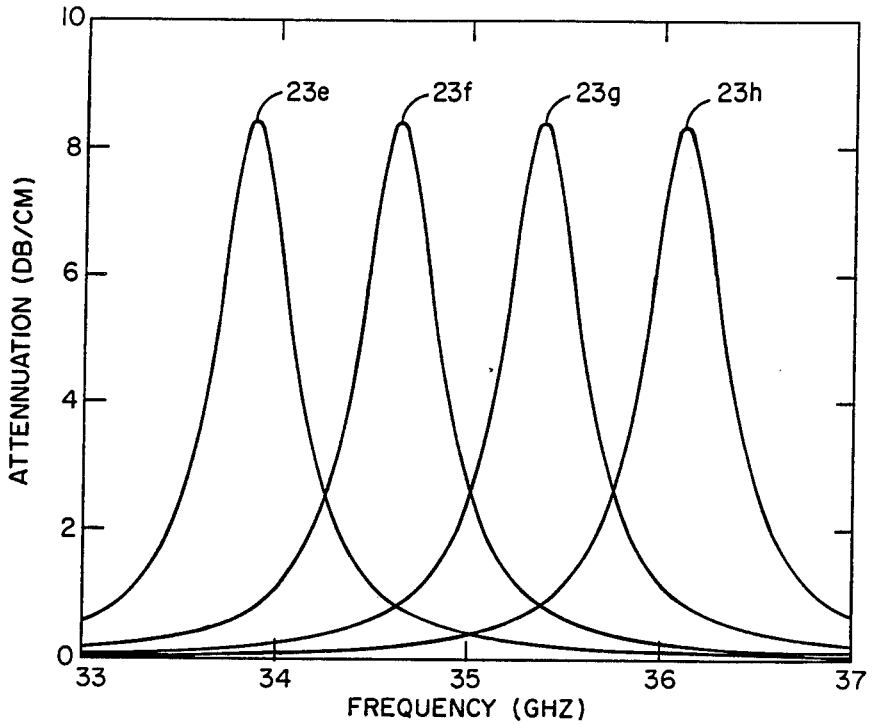

Referring now to FIGS. 4A and 4B, calculated plots 23a–23h of attenuation per unit length as a function of frequency at different field strengths between H=0 to H=5400 Oe. are shown. In FIG. 4A, curves 23a23d the external field H is varied in 100 Oe steps from H=0 curve 23a to H=300 curve 23d. In FIG. 4B, H is varied in 200 Oe steps from H=4800 0e (curve 23e) to H=5400 Oe (curve 23b). These calculations assume a substrate thickness of 100 micrometers, a film thickness of 0.03 micrometers, dielectric constant for the substrate of 10, saturation magnetization ($4\pi M_s$) 22,000 Oe, an anisotropy field $H_{an}=550$ Oe, $F_c=2\times10^8$ GHz, and $\lambda=0.004$. As shown, by increasing the external magnetic field, the stop band of the filter increases accordingly from approximately 9.86 GHz up through 36.2 GHz as shown for H=5400 Oe (curve 23n). Accordingly, a magnetically tuneable band stop filter is provided with this arrangement. FIGS. 4A–4B also show that the attenuation peaks can be tuned to relatively high frequencies with application of a relatively small external magnetic field. This compares favorably with the field requirements of YIG resonators.

In the calculations above, it is assumed that the electrical conductivity ($\sigma$) is equal to $1/8.85\times10^{-8}$ ohm meters, which is the accepted value of ($\sigma$) for bulk iron at room temperature. In practice, it is felt that in thin Fe films, the effective conductivity may be considerably smaller due to increase scattering of carriers at the film surfaces. Since attenuation per unit length is related to the conductivity of the nonmagnetic film, it is anticipated that the actual attenuation per unit length will be even greater than that shown above.

Referring briefly to FIG. 5, FIG. 5 shows the attenuation per unit length as a function of frequency for four values of the frequency term $f_c$ which is directly porportional to the conductivity ($\sigma$). In FIG. 5, curves 25a–25d represent values of $f_c$ equal to $2.0\times10^8$ GHz; $1.0\times10^8$ GHz, and $0.2\times10^8$ GHz. With decreasing conductivity (curve 25a to curve 25d), the peak attenuation increases significantly. As characterized by the frequency $f_c$, when $f_c$ is equal to $2\times10^8$ GHz (which corresponds to using a conductivity of the accepted bulk conductivity value), it is approximately 12 dB per cm at 9.86 GHz. Using a frequency $f_c$ which is $0.2\times10^8$ GHz shows an attenuation of approximately 28.5 dB per cm. Therefore, when the conductivity is decreased by a factor of 10 relative to the bulk conductivity of iron, the attenuation increases significantly from about 12 dB per cm to approximately 28.5 dB per cm.

Referring now to FIGS. 6A–6D, steps in the fabrication of a band stop filter 20' (FIG. 6D) having an epitaxial iron layer having an electrical conductivity substantially lower than bulk conductivity for iron will be described.

Figure 6B:
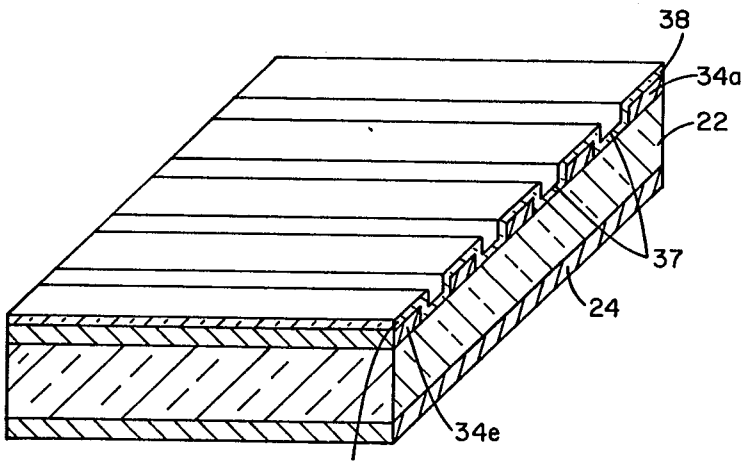
FIGS. 6A–6D are a series of isometric views showing steps in construction of a ferromagnetic film with an effective electrical conductivity smaller than the bulk conductivity of the material.
Figure 6D:
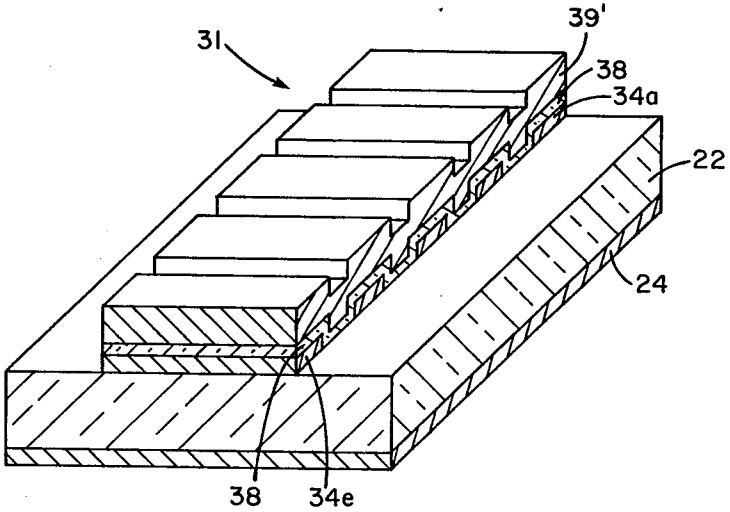
Figure 6A:
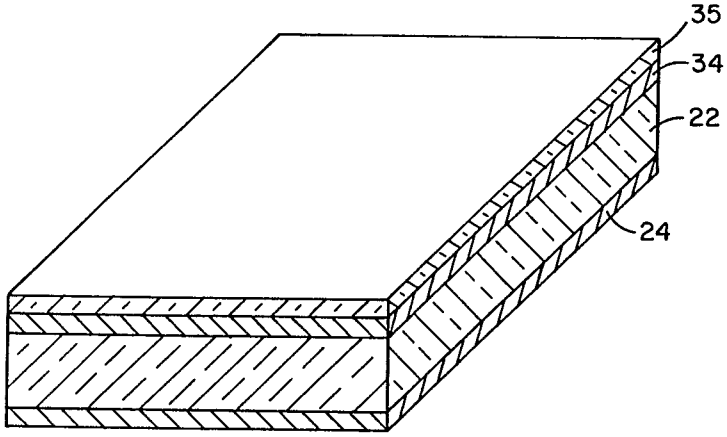

Referring first to FIG. 6A, substrate 22 has the ground plane 24 disposed over a first surface thereof, and is provided with a thin film of iron 34 over surface 22a having the thickness as selected above in conjunction with FIG. 2. The thin film of iron 34 is covered by a masking layer 35 which is patterned to provide a mask (not shown) which exposes selected underlying portions of the iron layer 34. As shown in FIG. 6B, the iron layer 34 is then etched away in the exposed portions to provide strips 34a spaced by thin grooves 37 disposed perpendicular to the direction of propagation of the microstrip conductor which will be fabricated later.

As also shown in FIG. 6B, after the grooves 34a are etched into the Fe film as by conventional chemical etching, the masking layer 35 is removed and the strips 34a of the Fe layer and the grooves 37 are covered with a thin insulating layer 38 of a material such as silicon oxide.

Figure 6C:
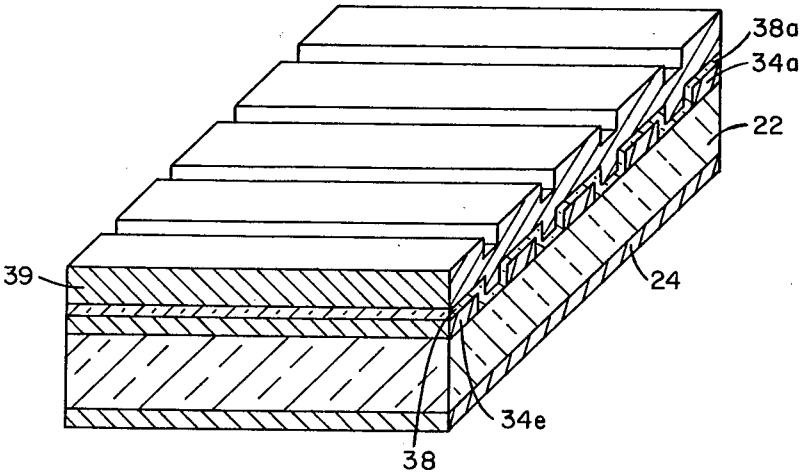

As shown in FIG. 6C, the insulating film 38 having disposed thereunder the patterned Fe layer 36 is covered with a relatively thick layer 39 of a conductive material such as aluminum or gold. As shown in FIG. 6D, the grooved Fe film and conductive layer 39 are then patterned to provide the microstrip strip conductor with a selected width and length as in FIG. 2 to provide band stop filter 20'.

The effective electrical conductivity of the Fe film 34 for the arrangement shown in FIG. 6D will be substantially less than the effective electrical conductivity of the Fe layer 27 shown in FIG. 2 because the path of current flow in the Fe layer 27 is interrupted by the insulating layer 38, whereas the insulating layer 38 allows the magnetic field of the signal fed to the conductor 39 to interact with the ferromagnetic Fe layer 34.

Figure 7A:
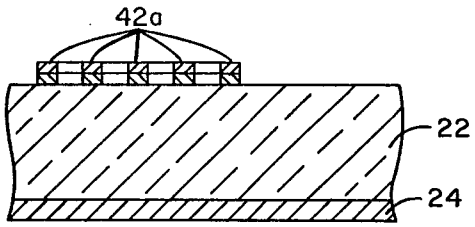
FIG. 7A is a cross-sectional view taken along lines 7A—7A of FIG. 7.
Figure 7:
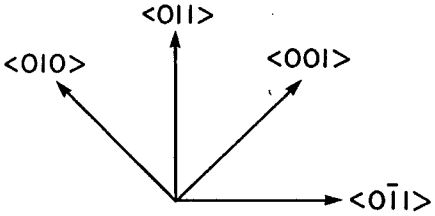
FIG. 7 is a plan view of a meandered strip conductor band reject filter with a diagram showing conductor orientation with respect to crystalline axes in accordance with a further aspect of the present invention.
Figure 7:
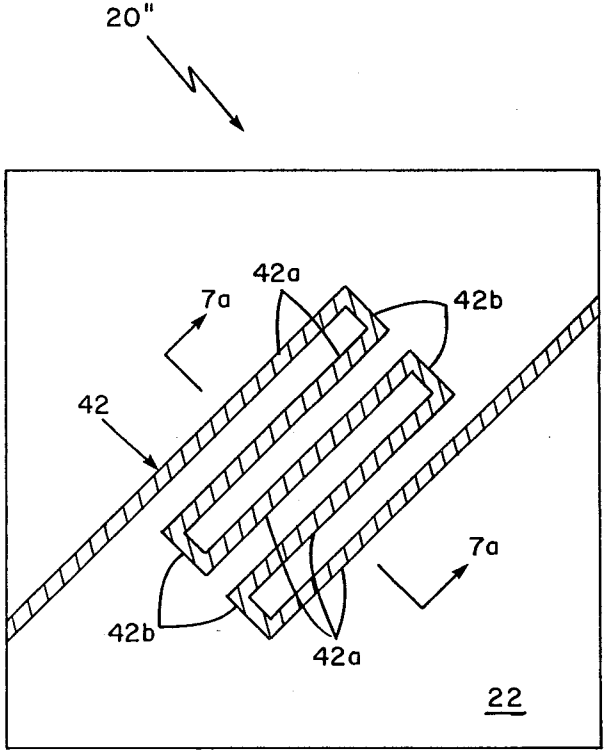

Referring now to FIGS. 7 and 7A, a compact band stop filter 20'' having a high attenuation per unit length is shown to include a composite meandered strip conductor 42 including a Fe film 44 having an effective conductivity which is equal to bulk Fe conductivity disposed on the GaAs substrate 22 and a conductive, non-magnetic layer 43 diposed over the Fe layer 44. The meandered strip conductor 42 has long leg portions 42a which are disposed parallel to one of the in-plane easy axes of the Fe film as generally described earlier and a plurality of short legs 42b which are disposed parallel to a second one of the in-plane directions of the Fe film and orthogonal to the long leg portions 42a. The meandered (i.e. multiple folded) strip conductor 42 provides a band strip filter which occupies a substantially smaller area to provide a selected attenuation per unit length than if the device were provided as a single long strip conductor.

It may be further understood that the iron film having reduced bulk conductivity as described in FIG. 6 may be used with the meandered line shown in FIG. 7 to provide a band stop filter having an even higher attenuation per unit length.

Figure 8:
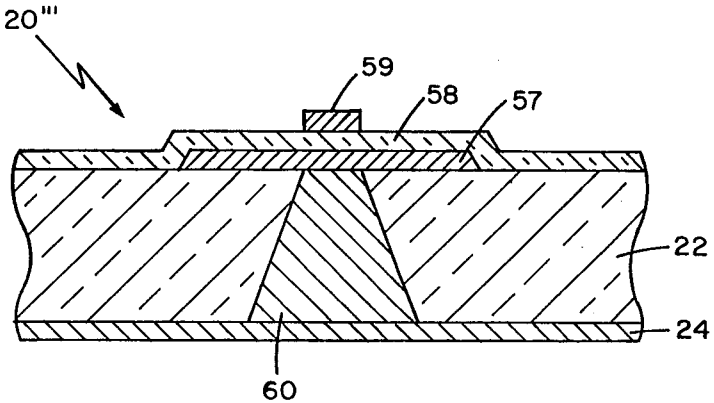
FIG. 8 is a cross-sectional view of a further embodiment of a band reject filter having a high degree of attenuation.

It should now be appreciated that one of the important considerations in providing a band stop filter is the thickness of the dielectric spacing between the composite strip conductor and the ground plane conductor disposed on the gallium arsenide substrate. In general, the thinner the dielectric the higher the attenuation per unit length of the band stop filter. Accordingly, it is desirable to provide a relatively thin dielectric spacing between the ground plane conductor and the composite strip conductor of the band stop filter. Several techniques accordingly are available for providing such an arrangement. One technique in particular would be to etch the gallium arsenide substrate in a region thereof underlying the Fe layer to provide a tub structure thereunder. A preferred technique, however, is as shown in FIG. 8. 15 Referring now to FIG. 8, a band stop filter 20''' is shown to include here a gallium arsenide substrate 22 having disposed over a first surface thereof a ground plane conductor 24 and disposed over a second surface thereof a layer of a magnetic material such as iron as described above. Disposed over said iron layer 57 is a dielectric layer 58 comprised of a material such as silicon nitride ($Si_3N_4$) or silicon dioxide ($SiO_2$). The dielectric layer 58 is provided to have a selected, controlled thickness generally in the order of about 1 micron. Disposed over the dielectric layer 58 is a conductive layer 59 which is patterned to provide in combination with the dielectric 58 and iron layer 57 a microstrip transmission line having a selected characteristic impedance. Since the dielectric for the microstrip transmission line is provided by the relatively thin dielectric layer 58 and further since the ground plane conductor for the microstrip transmission line is provided by the iron layer 57, generally the width of the conductive layer 59 would be about 1/10 width of the iron layer 57. Further, since the iron layer 57 must be electrically connected to the ground plane conductor 22, via holes 60 are here disposed through the substrate 22 to provide electrical connection between the ground plane conductor 24 and the iron layer 57. Preferably, such via holes 60 are provided at the input and output terminals of the bandpass filter. Alternate arrangements such as the use of coplanar waveguide at inputs and outputs of the filter may be used. Since the attenuation per unit length is a function of the dielectric separation between the strip conductors and the ground plane conductor, the arrangement described in conjunction with FIG. 8 will provide a band stop filter having significantly higher attenuation per unit length.

Figure 9B:
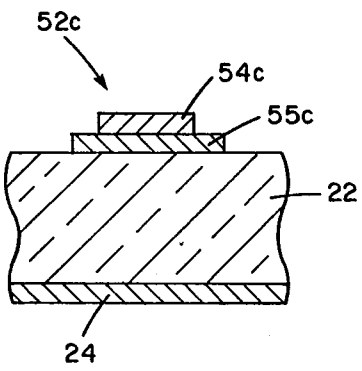
FIG. 9B is a cross-sectional view taken along lines 9B—9B of FIG. 9A.
Figure 9A:
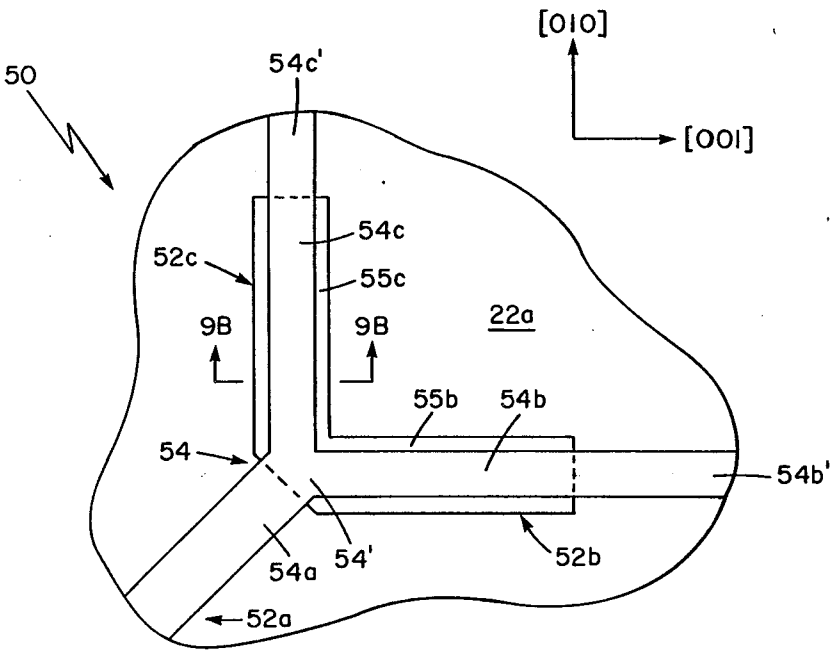
FIG. 9A is a plan view of a single pole, double-throw switch having a ferromagnetic material as a switching element with a diagram showing conductor orientation with respect to crystalline axes in accordance with a still further aspect of the present invention.

Referring now to FIGS. 9A and 9B, an alternate embodiment of the present invention is shown. Here a single-pole, double-throw switch 50 is disposed on a substrate 22 having a ground plane conductor 24 disposed thereover as generally described in conjunction with FIG. 2. Here a pair of composite strip conductor sections are disposed mutually orthogonal to one another and parallel to the pair of easy axis of the gallium arsenide substrate 22. A third leg of said single pole, double-throw switch 50 comprised of a single layer of a conductive non-magnetic material such as gold is disposed on substrate surface **22*a* opposite the intersection of the pair of orthogonal composite strip conductors 52*b* and 52*c*, as shown. The device described in conjunction with FIGS. 9A and 9B when magnetized in one of its "easy directions", provides a single-pole, double-throw switch which has a broadband low insertion loss characteristic in one branch and a relatively narrow-band high absorption characteristic in the other branch. The branch in which the direction of magnetization is normal to the propagation direction has a low insertion loss, whereas the branch in which the direction of magnetization is parallel to the propagation direction has a high insertion loss. Here, the characteristic impedance of the input microstrip line shown in FIG. 9A is chosen to be half of the characteristic impedance of the output lines; and therefore, the energy of a wave entering the junction from the input side will be split in half with no energy being reflected. If the Fe film is magnetized uniformly in either the <010> or the <001> directions, one of the output branches will have a much higher attenuation than the other due to the excitation of ferromagnetic resonance at a certain frequency. Therefore, the structure shown in FIG. 9A** acts as a single pole, double-throw switch.

Moreover, the structure shown in FIG. 2 may also be used as a switch. As described in conjunction with FIG. 2, the attenuation applies only to the band stop filter when the DC magnetic moment is parallel to the microstrip transmission line. Another stable orientation of the DC magnetic moment is perpendicular to the microstrip transmission line. In this latter orientation, the ferromagnetic resonance is not excited because the r.f. magnetic field is substantially parallel to the DC magnetization; and therefore, the structure shown in FIG. 2 can also be used as an on/off switch that has a broadband low insertion loss in one state and relatively narrow band high insertion absorption in the other state.

Figure 10:
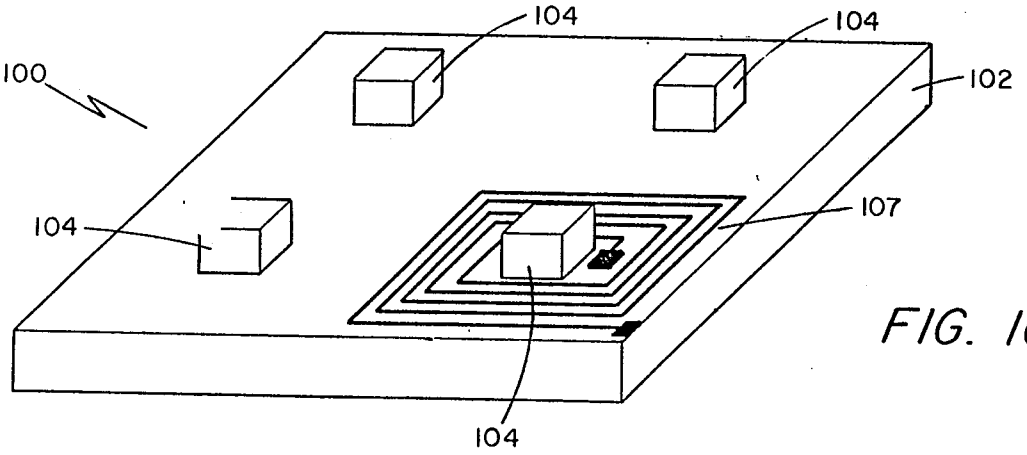
FIG. 10 is an isometric view of an electromagnetic assembly useful to provide the external magnetic field for the device as shown in FIGS. 2, 7, and 8.

Referring now to FIG. 10, a small electromagnet 100 suitable for use for the band stop filter shown for example in FIG. 7 is shown to include a substrate 102 comprised of a ferrite such as Li-ferrite or Li-Zn ferrite having four salients 104 disposed over an upper surface thereof and photo etched coils 107 disposed around each one of the salients 104, (only one being shown). The photo etched coils 107 provide in combination with the ferrite plate 102 an electromagnet. By providing a current through each one of the coils with one of two possible polarities, a magnetic field can be generated near the center of the plate 102. In particular, the magnetic field direction can be varied from being parallel to a first set of opposing plate edges to being parallel to a second, different set of opposing plate edges, and thus orthogonal to the first set of plate edges. This is accomplished by simply changing the polarity of the current directed through each one of the coils. Therefore, the electromagnet illustrated in FIG. 10 can generate a magnetic field that has a pair of directions required for switching a band reject filter, as well as, for the single pole, double-throw switch as described in conjunction with FIGS. 2–9B above.

An estimate of the strength of the magnetic field which can be generated by the electromagnet shown in FIG. 10 is given below:

In order to estimate the strength of the magnetic field that can be generated by the electromagnet shown in FIG. 10, consider the example summarized in Table 1. Assume also that the voltage applied to the coil is 24 volts. Since the resistance is 144 Ohm the current is I=1/6 Amp and the power dissipated (per coil) P=4 Watt. The heat generated in the coil can be removed by means of a metal block (not shown) with cooling fins, which is bonded to the back of the ferrite plate.

TABLE 1

Typical Parameters for Small Electromagnets Such as Shown in FIG. 9

| | |
|---|---|
| Overall size of electromagnet | 5 mm × 5 mm × 1.5 mm |
| Width of each salient | 0.5 mm |
| Width of conductors | 10 μm |
| Height of conductors | 5 μm |
| Spacing between conductors | 10 μm |
| Length of conductor (each coil) | 0.3 m |
| Number of turns (each coil) | 50 |
| Resistance (each coil) (assuming $\rho = 2.4 \times 10^{-8}$ Ohm m) | 144 Ohm |

The magnetic fieldstrength generated at the center of the electromagnet is approximately given by $$H \simeq \frac{IN}{D} \tag{1}$$

where I is the current, N the number of turns and D the pole-to-pole distance. Since D=2 mm in the example of Table 1, the estimated fieldstrength is $$H \simeq \frac{50}{6 \times 1.2} \frac{\text{AMP}}{\text{cm}} = 41.67 \frac{\text{AMP}}{\text{cm}} 52.36 = \text{Oersted}^{(2)}$$

Assuming that the coercivity of the Fe films is approx. 6 Oersted, the field generated by the coil is therefore more than adequate to switch the magnetization from one easy direction to another.

Figure 11:
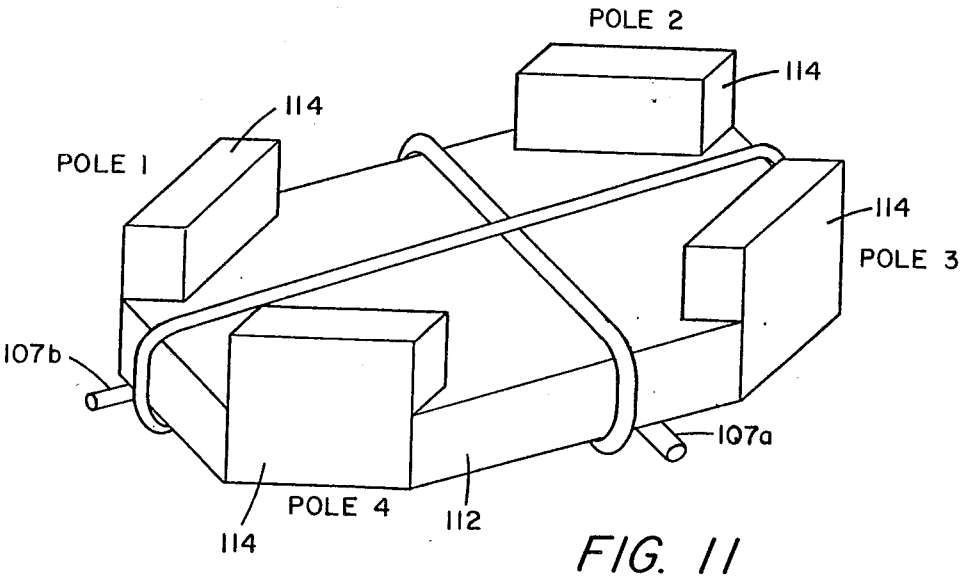
FIG. 11 is an isometric view of an alternate design for a magnet assembly for use with the circuit shown in FIGS. 2, 7, and 8.

Referring now to FIG. 11, an alternate embodiment 110' for a small electromagnet suitable for use with the switcheable band reject filters 20'-20''' and switch 50 is shown. This electromagnet includes a substrate 112 comprised of a magnetic material having a high permeability such as a ferrite or a nickel iron alloy which is machined to have octagonal configuration with four salients 114 disposed within and protruding from the walls of the octagonal shaped substrate 112 as shown. Wires 107*a* and 107*b* are coiled about pairs of opposing surfaces of the octagonal shaped substrate 112 to form first and second magnetic circuits, as also shown. For optimum performance, both circuits are activated at the same time and depending upon the polarity of the currents fed to each of the coils, the resulting magnetic field near the center of the structure will be either in a direction from pole 1 to pole 3 or in a direction from pole 2 to pole 4; and thus, the electromagnet 110 shown in FIG. 10 also can generate a pair of magnetic fields having the directions required for the switcheable bandpass filter, band stop filter (FIG. 2), and a single pole, double-throw switch 50 (FIG. 9).

Figure 12:
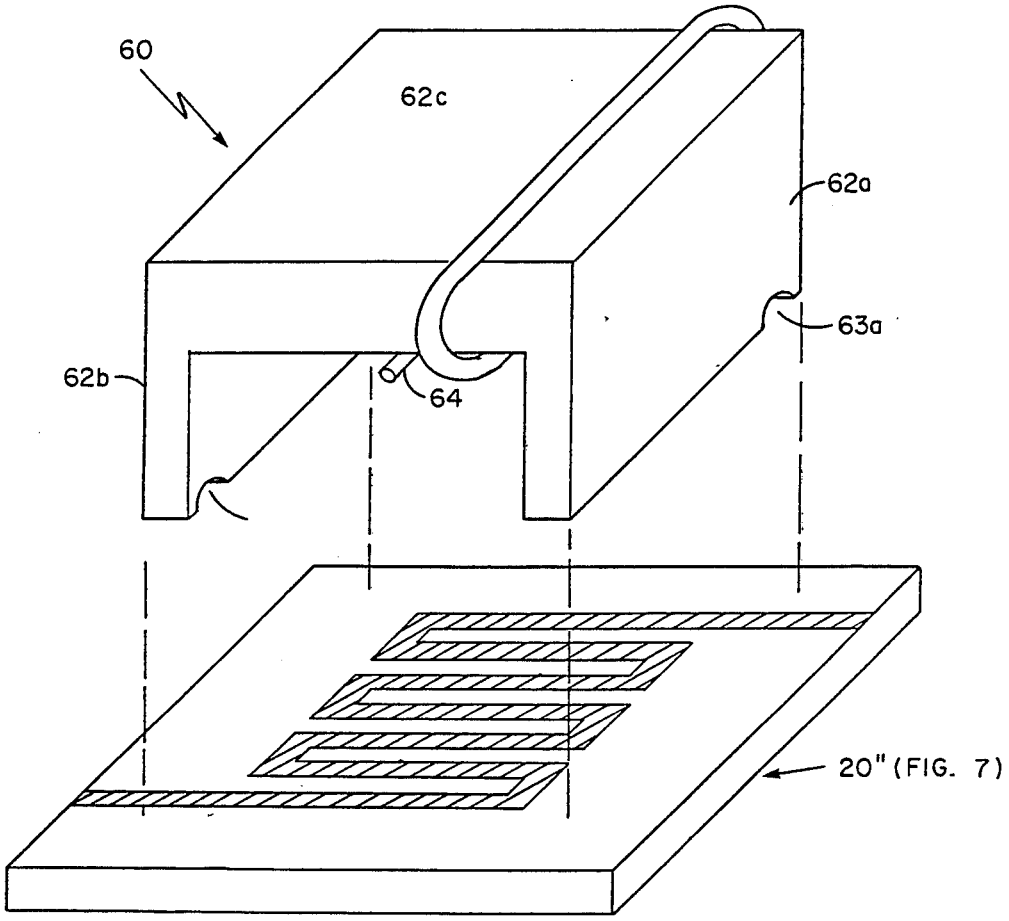
FIG. 12 is a composite isometric view showing a further alternate embodiment of an electromagnet disposed on the band reject filter of FIG. 7.

Referring now to FIG. 12, a further alternate embodiment 60 for a small electromagnet suitable for use with the switcheable band stop filter described in conjunction with FIG. 7 in particular is shown. Here the electromagnet 60 includes a semi-toroidal shaped member 62 having leg portions 62*a*, 62*b* disposed from a base portion 62*c* all comprised of a high permeability magnetic material. The semi-toroidal member 62 has regions 63*a*, 63*b* removed which will permit the toroidal member to be mounted on the substrate 22 of the band stop filter in such a manner that the toroid 62 does not electrically interfere with the meandered strip conductor 42. A coil of wire 64 (one turn shown) is wound about the base portion 62*c* and the electromagnet is disposed over the meandered strip line 42, onto substrate 24 as shown. Here only a single turn is shown although several turns obviously would be provided in order to increase the field strength. This coil of wire 64 is fed by a current and the semi-toroidal assembly 62 is used to provide a field which is parallel to the long branches of the meandered line.

Figure 13:
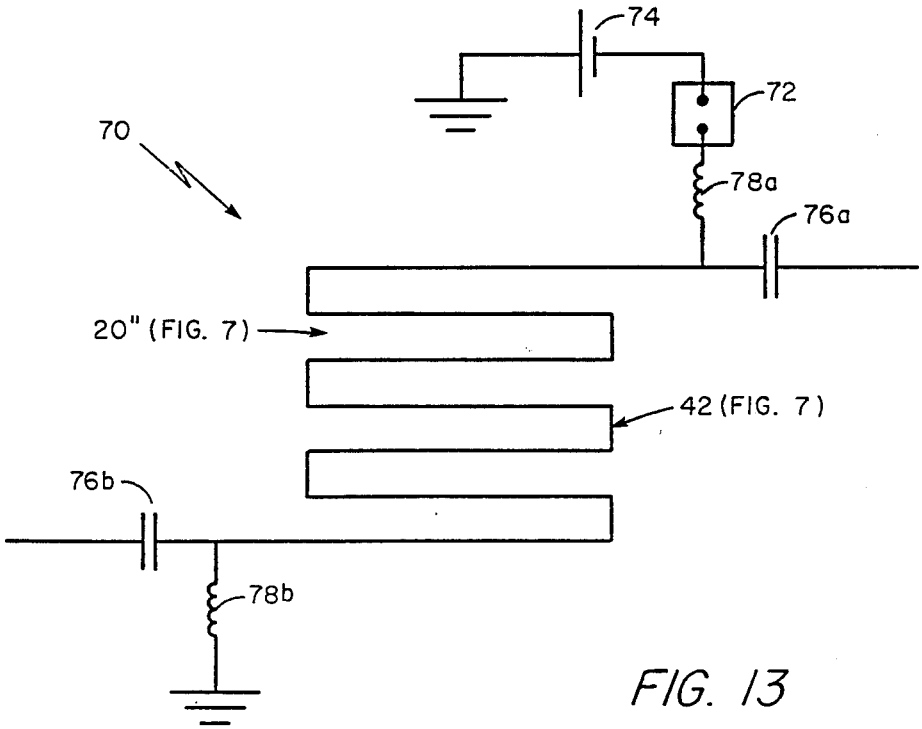
FIG. 13 is a schematic diagram of an electrical circuit used with the electromagnet shown in FIG. 12.

Referring now to FIG. 13, a schematic diagram of an electrical circuit 70 used to generate an external magnetic field is shown. The circuit 70 includes a switch 72 which is used to selectively couple a current pulse from a source 74 through the meandered line 42 (FIG. 7) and a pair of high pass filters 76*a*, 76*b* used to block the current pulses from the remainder of the system within which the band pass filter 20'' (FIG. 7) is disposed. The high pass filters 76*a*, 76*b* are here provided by D.C. blocking capacitors. Circuit 70 also includes a pair of low pass filters 78*a*, 78*b*, here inductors to provide a low impedance path for the current pulse from the switch to ground through the meandered line 42. A current directed through the meandered line 42 (FIG. 7) provides in response thereto a magnetic field perpendicular to the meandered line. This field is substantially orthogonal to the magnetic field generated by the external electromagnet described in conjunction with FIG. 12. The current directed through the meandered line which is an integral part of the bandpass filter produces a magnetic field perpendicular to this line whereas, the external electromagnet (FIG. 12) provides the required magnetic field parallel to the long branches of the meandered line. This arrangement has two particular advantages: One advantage is that in a low absorption state (i.e. where the D.C. current is directed through the line by the circuit of FIG. 13) of the switcheable band stop filter, the magnetization of the Fe film is everywhere perpendicular to the meandered line not just in the long branches of this line as in the approaches in FIGS. 10 and 11. Thus, the insertion loss in the low absorption state is expected to be substantially lower for a filter using the electromagnet shown in FIGS. 12 and 13 than for a filter using the electromagnet shown in FIGS. 10 or 11. Secondly, since the external electromagnet shown at FIG. 12 is used exclusively for generating the magnetic field parallel to the microstrip lines, it can be designed to achieve an optimum or higher field strength than the electromagnet shown in FIGS. 10 and 11. This would indicate that the structure shown in FIG. 12 will have a greater tuneability range than those described in conjunction with FIGS. 10 and 11.

Each of the circuits described above have been shown with a conductive layer disposed symmetrically over the ferromagnetic material. This arrangement in general provides a reciprocal device. However, it is believed that a non-reciprocal device would be provided if the conductive layer is disposed to one side of a ferromagnetic material layer, such that the conductive layer is no longer symmetrically disposed with respect to the ferromagnetic material.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. A microwave circuit element, comprising:

a dielectric substrate;

a ground plane conductor disposed over a first surface of said substrate;

a patterned composite strip conductor disposed over a second opposing surface said substrate, said patterned composite strip conductor, comprising:

a first layer comprising a magnetic material disposed on said substrate and having a pair of easy axes disposed in the plane of said second opposing surface of said substrate;

a second layer of a conductive nonmagnetic material, disposed over said layer of magnetic material;

means for providing a magnetic field parallel to at least a portion of said pattern composite strip conductor; and wherein said patterned, composite conductor is disposed parallel to one of the easy axis of said magnetic material.

2. The microwave circuit element of claim 1 wherein said second layer of conductive non-magnetic material is disposed on said first layer of magnetic material, and said first layer is a conductive ferromagnetic material.

3. The microwave circuit of claim 2 wherein said second surface of said substrate is a (100) orientated surface of a single crystal material having a cubic crystal structure.

4. The microwave circuit of claim 3 wherein said magnetic material has a crystal structure with <001> and <010> directions corresponding to said pair of easy axis which lie in the plane of the (100) orientated substrate.

5. The microwave circuit of claim 4 wherein said composite strip conductor has a length dimension which is parallel to one of said <001> and <010> directions of said magnetic material layer.

6. The microwave circuit element of claim 1 further comprising a layer of dielectric, said layer of dielectric being disposed between said first layer of magnetic material and said second layer of conductive nonmagnetic material, and wherein said first layer of magnetic material is a conductive ferromagnetic material.

7. The microwave circuit element of claim 6 further comprising means for connecting said first layer of magnetic material to the ground plane conductor.

8. The microwave circuit element of claim 7 wherein said means for connecting the first layer to the ground plane includes at least one via hole disposed through the substrate.

9. The microwave circuit of claim 8 wherein said second surface of said substrate is a (100) orientated surface of a single crystal material having a cubic crystal structure.

10. The microwave circuit of claim 9 wherein said magnetic material has a crystal structure with <001> and <010> directions which lie in the plane of the (100) orientated substrate.

11. The microwave circuit of claim 10 wherein said composite strip conductor has a length dimension which is parallel to one of said <001> and <010> directions of said Fe layer.

12. A band reject filter, comprising:

a substrate comprised of GaAs having a (100) orientated surface;

a patterned composite strip conductor disposed on said (100) orientated surface comprising:

a first layer of a crystalline ferromagnetic material having a pair of easy axis which lie in the plane of said (100) orientated surface;

a second layer disposed on said first layer, comprising a conductive, nonmagnetic material with said second layer and first layers patterned such that said patterned composite strip conductor has a dimension parallel to one of said easy axes of said first layer of ferromagnetic material.

13. The band reject filter of claim 12 wherein said ferromagnetic material is a layer of Fe having <010> and <001> direction in the plane of said substrate.

14. the band reject filter of claim 13 wherein said filter further includes means for providing a magnetic field having a field component disposed parallel to at least one of said <010> and <001> directions.

15. The band reject filter of claim 14 wherein said filter further includes means for providing a magnetic field having a field component parallel to one of said <010> and <001> directions in a first mode to excite ferromagnetic resonance in said ferromagnetic material, and for providing a magnetic field having a field component normal to the input signal propagation direction and in the plane of said orientated surface to inhibit excitation of ferromagnetic resonance.

16. The band reject filter of claim 15 wherein said patterned composite strip conductor is patterned to provide a meandered strip conductor having first relatively long leg portions disposed parallel to the one of said <010> and <001> directions and second relatively short leg portions disposed parallel to the other one of said <010> and <001> directions.

17. The band reject filter of claim 13 wherein said Fe layer is comprising of a plurality of dielectrically spaced magnetically coupled strip portions disposed orthogonal to the propagation direction of an input signal fed to the patterned composite strip conductor.

18. The band reject filter of claim 14 wherein said means for providing a magnetic field changes the ferromagnetic resonance frequency (fres) the Fe layer in a manner related to $$f_{res} = \frac{\gamma}{2\pi} \{(H + H_{an})(H + H_{an} + 4\pi M_s)\}^{\frac{1}{2}},$$

where H is the field provided from the means for providing a magnetic field and $H_{an}$ is the anisotropy field, $4\pi M_s$ is the saturation magnetization and $\gamma$ is the gyromagnetic ratio of the Fe layer.

19. The band reject filter of claim 17 wherein said means for providing a magnetic field changes the ferromagnetic resonance frequency ($f_{res}$) the Fe layer in a manner related to $$f_{res} = \frac{\gamma}{2\pi} \{(H + H_{an})(H + H_{an} + 4\pi M_s)\}^{\frac{1}{2}},$$

where H is the field provided from the means for providing a magnetic field and $H_{an}$ is the anisotropy field, $4\pi M_s$ is the saturation magnetization and $\gamma$ is the gyromagnetic ratio of the Fe layer.

20. An r.f. switch, comprising:

a substrate comprised of GaAs having a (100) orientated surface;

a patterned composite strip conductor disposed over said (100) orientated surface, comprising:

a first layer comprised of a magnetic material having a pair of easy axes which lie in the plane of said (100) orientated surface, said layer having first and second patterned portions which have a common terminus and are disposed orthogonal to one another in the common plane of said (100) surface, said first and second patterned portions being further disposed parallel to respective ones of said easy axes of said magnetic material;

a second layer comprising a conductive, nonmagnetic material disposed on said first layer, said second layer having first and second mutually orthogonal portions having a common terminus and disposed over said respect first and second patterned portion of said first layer, and a third portion connected with the common terminus of said first and second portions of said second layer, with said third portion of said second layer being disposed on said substrate.

21. The r.f. switch as recited in claim 20 wherein said first layer of said composite strip conductor is comprised of Fe.

22. The r.f. switch as recited in claim 21 wherein said Fe layer has <010> and <001> in the plane of of said substrate which correspond to the directions of the pair of easy axis of said magnetic material.

* * * * *